US009090425B2

(12) United States Patent
Kimura

(10) Patent No.: US 9,090,425 B2
(45) Date of Patent: Jul. 28, 2015

(54) RECORDING MATERIAL PROCESSING APPARATUS AND IMAGE FORMING SYSTEM

(71) Applicant: FUJI XEROX CO., LTD., Tokyo (JP)

(72) Inventor: Masatoshi Kimura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 24 days.

(21) Appl. No.: 13/903,516

(22) Filed: May 28, 2013

(65) Prior Publication Data

US 2014/0175728 A1 Jun. 26, 2014

(30) Foreign Application Priority Data

Dec. 25, 2012 (JP) ..... 2012-281655

(51) Int. Cl.

| | |
|---|---|
| ***B65H 37/04*** | (2006.01) |
| ***B65H 29/12*** | (2006.01) |
| ***B42C 1/12*** | (2006.01) |
| ***B65H 39/00*** | (2006.01) |
| ***B31F 5/00*** | (2006.01) |
| ***B65H 31/30*** | (2006.01) |
| ***B65H 29/14*** | (2006.01) |
| ***G03G 15/00*** | (2006.01) |

(52) U.S. Cl.

CPC ..... *B65H 29/125* (2013.01); *B31F 5/001* (2013.01); *B42C 1/12* (2013.01); *B65H 29/14* (2013.01); *B65H 31/30* (2013.01); *B65H 37/04* (2013.01); *B65H 39/00* (2013.01); *G03G 15/6541* (2013.01); *B65H 2301/4212* (2013.01); *B65H 2301/4213* (2013.01); *B65H 2301/42146* (2013.01); *B65H 2402/441* (2013.01); *B65H 2403/942* (2013.01); *B65H 2404/166* (2013.01); *B65H 2404/632* (2013.01); *B65H 2601/11* (2013.01); *B65H 2801/27* (2013.01)

(58) Field of Classification Search

CPC ..... B65H 37/04; B65H 31/30; B65H 39/00; B42C 1/12; B31F 5/001

USPC ..... 270/58.07, 58.08, 37; 399/407, 408, 399/410

See application file for complete search history.

(56) References Cited

U.S. PATENT DOCUMENTS

| | | | | |
|---|---|---|---|---|
| 6,102,385 | A * | 8/2000 | Wakamatsu et al. | 270/58.12 |
| 6,145,825 | A | 11/2000 | Kunihiro et al. | |
| 7,284,752 | B2 * | 10/2007 | Nagata et al. | 270/58.18 |

(Continued)

FOREIGN PATENT DOCUMENTS

| | | |
|---|---|---|
| JP | A 11-130338 | 5/1999 |
| JP | A 2008-184325 | 8/2008 |

*Primary Examiner* — Leslie A Nicholson, III
(74) *Attorney, Agent, or Firm* — Oliff PLC

(57) ABSTRACT

A recording-material processing apparatus includes a biding mechanism that moves along a predetermined movement path and binds a recording material stack; a recording-material transport path along which the recording material is transported, the recording-material transport path extending from a first area to a second area, which are next to each other with the movement path therebetween, and extending beside the movement path; a first transport member that is provided in the first area, at a position away from the portion of the recording-material transport path extending beside the movement path, to transport the recording material on the recording-material transport path to the second area; and a second transport member that is provided in the second area, at a position away from the portion of the recording-material transport path extending beside the movement path, to transport the recording material transported by the first transport member to the further downstream side.

4 Claims, 14 Drawing Sheets

(56) References Cited

U.S. PATENT DOCUMENTS 7,699,302 B2 * 4/2010 Ichikawa ..... 270/58.12
7,832,718 B2 * 11/2010 Fukasawa et al. ..... 270/58.07
7,862,022 B2 * 1/2011 Kitahara ..... 270/58.08
7,862,023 B2 * 1/2011 Ichihashi et al. ..... 270/58.09
7,866,650 B2 * 1/2011 Nomura et al. ..... 270/58.12
8,393,607 B2 * 3/2013 Masunari et al. ..... 270/58.08

* cited by examiner

RECORDING MATERIAL PROCESSING APPARATUS AND IMAGE FORMING SYSTEM

CROSS-REFERENCE TO RELATED APPLICATIONS

This application is based on and claims priority under 35 USC 119 from Japanese Patent Application No. 2012-281655 filed Dec. 25, 2012.

BACKGROUND

Technical Field

The present invention relates to recording-material processing apparatuses and image forming systems.

SUMMARY

According to an aspect of the invention, there is provided a recording-material processing apparatus including a biding mechanism that moves along a predetermined movement path and binds a recording material stack; a recording-material transport path along which the recording material is transported, the recording-material transport path extending from a first area to a second area, the first area and the second area being next to each other with the movement path therebetween, and extending beside the movement path; a first transport member that is provided in the first area, at a position away from the portion of the recording-material transport path extending beside the movement path, to transport the recording material on the recording-material transport path to the second area; and a second transport member that is provided in the second area, at a position away from the portion of the recording-material transport path extending beside the movement path, to transport the recording material transported by the first transport member to the further downstream side.

According to this aspect of the invention, the size of the recording-material processing apparatus including the biding mechanism, which binds a recording material stack, and the recording-material transport path, along which the recording material is transported, may be reduced.

BRIEF DESCRIPTION OF THE DRAWINGS

An exemplary embodiment of the present invention will be described in detail based on the following figures, wherein.

DETAILED DESCRIPTION

Figure 1:
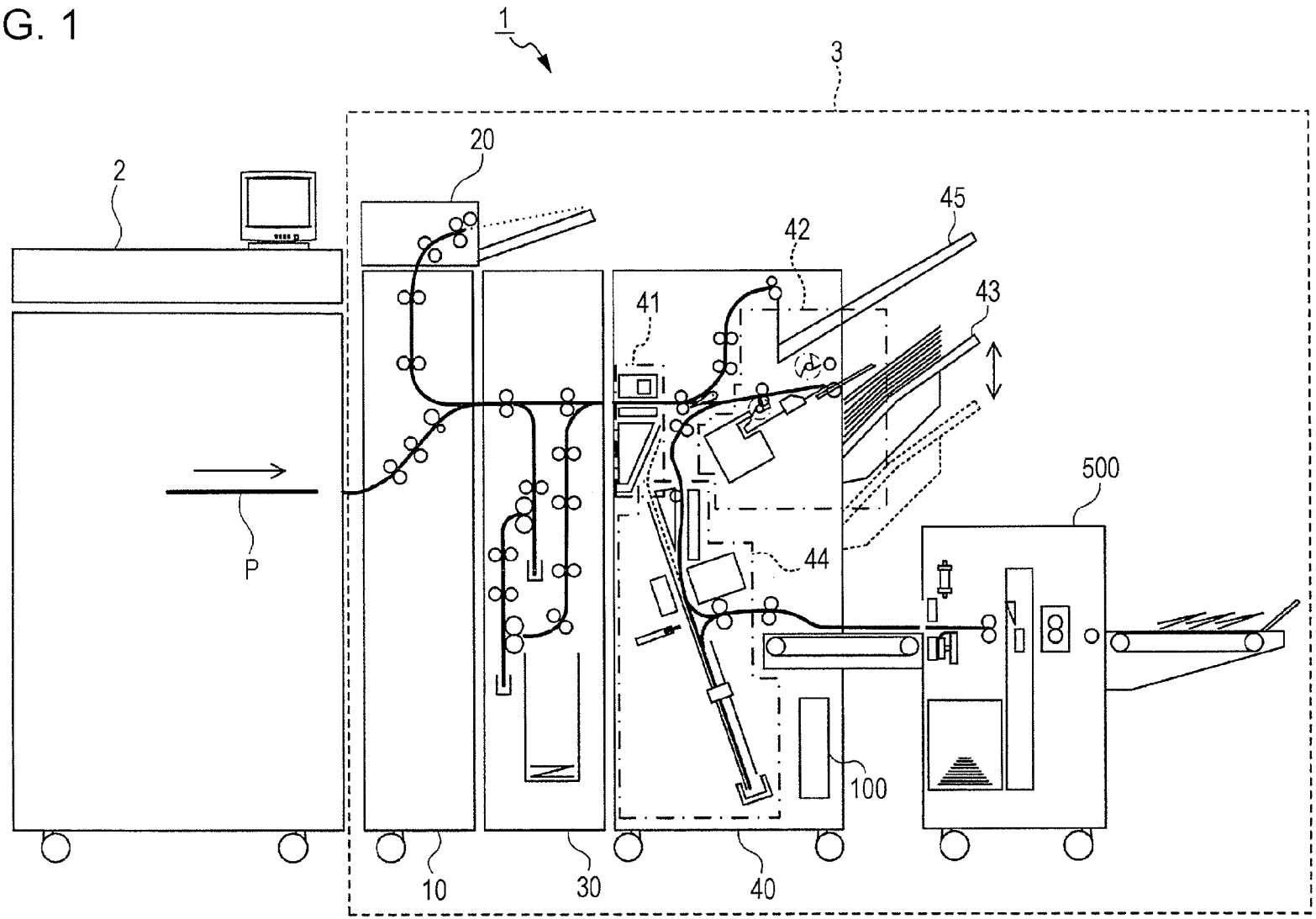
FIG. 1 illustrates the overall configuration of an image forming system according to an exemplary embodiment.

An exemplary embodiment of the present invention will be described in detail with reference to the attached drawings. FIG. 1 illustrates the overall configuration of an image forming system according to this exemplary embodiment. The image forming system 1 illustrated in FIG. 1 includes an image forming apparatus 2 that uses, for example, an electrophotographic system to form a color toner image on a sheet P, which is an example of a recording material; and a sheet processing apparatus 3 that performs predetermined processing on the sheet P having the toner image formed thereon with the image forming apparatus 2. Although the image forming apparatus 2 according to this exemplary embodiment uses an electrophotographic system to form an image, the image forming apparatus 2 may be, for example, an ink jet printer.

The sheet processing apparatus 3 includes a transport unit 10 that transports a sheet P output from the image forming apparatus 2 to a further downstream side; a slip-sheet supplying unit 20 that supplies a slip sheet, such as a cardboard sheet or a windowed sheet, to the sheet P transported by the transport unit 10; a folding unit 30 that folds the sheet P transported from the transport unit 10 (e.g., C folding and Z folding); a first post-processing unit 40 provided downstream of the folding unit 30 to perform processing, such as perforation, side stitching, or saddle stitching, on the sheet P; a second post-processing unit 500 provided downstream of the first post-processing unit 40 to perform extra processing on a half-folded, saddle-stitched sheet stack P (book); and a controller 100 that is formed of central processing unit (CPU) controlled by a program and controls the overall sheet processing apparatus 3.

As illustrated in FIG. 1, the first post-processing unit 40, which is an example of a recording-material processing apparatus, includes a perforation unit 41 that perforates (punches) a sheet P; a side-stitch stapler unit 42 that binds an end of a sheet stack P; a first stack portion 43 on which side-stitched sheet stacks P are piled up to allow a user to easily take them up; a saddle-stitch unit 44 that folds a sheet stack P in half and binds the sheet stack at the center to form a double-spread book; and a second stack portion 45 on which sheets P that are not processed by the first post-processing unit 40 or that are just perforated are stacked.

Figure 2:
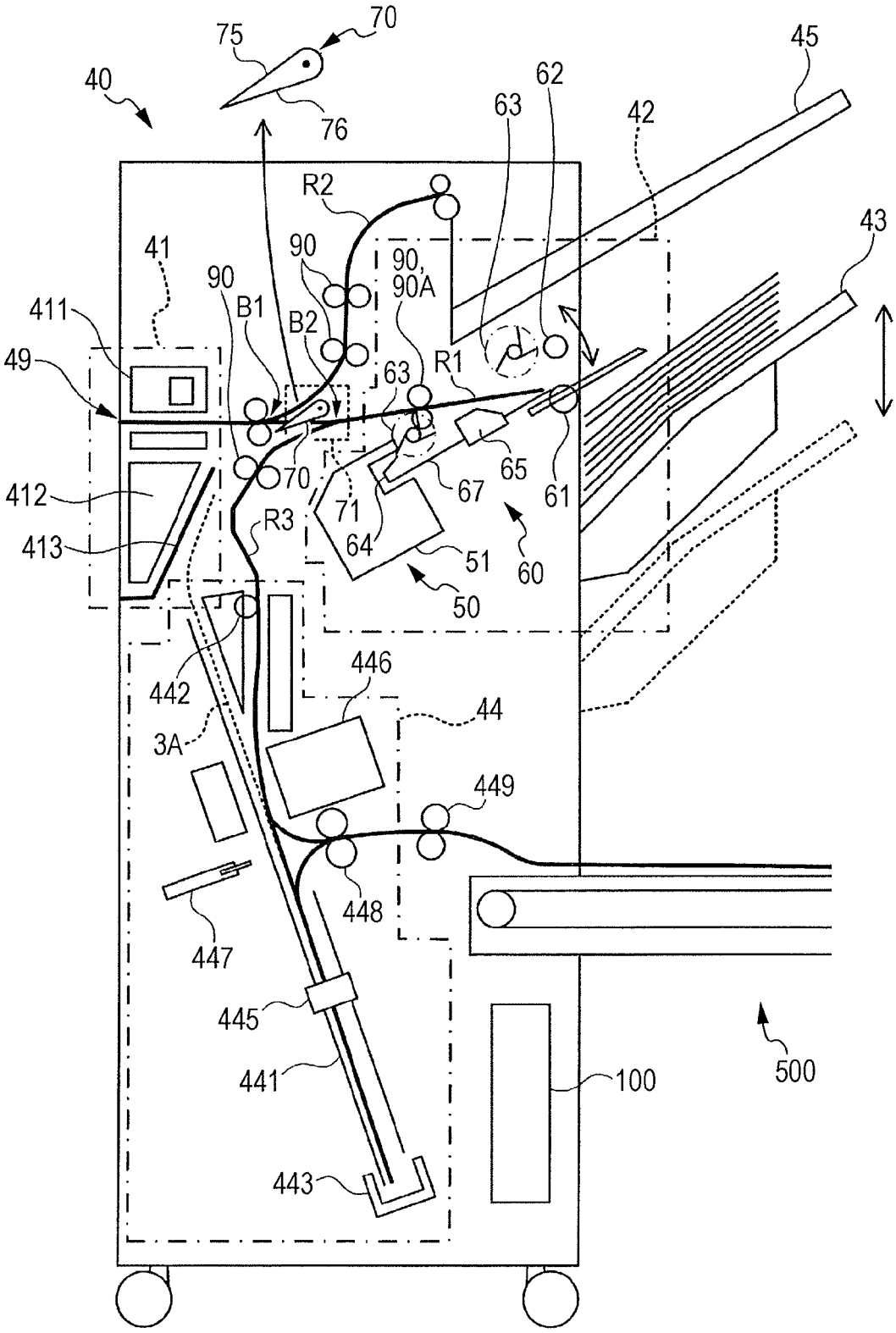
FIG. 2 is a diagram for explaining the configuration of a first post-processing unit.

FIG. 2 is a diagram for explaining the configuration of the first post-processing unit 40. As illustrated in FIG. 2, the first post-processing unit 40 has an introduction port 49 from which a sheet P transported from the folding unit 30 is introduced, and a first sheet-transport path R1 extending from the introduction port 49 to the side-stitch stapler unit 42. The first sheet-transport path R1 transports the sheet P introduced from the introduction port 49 to the side-stitch stapler unit 42.

The first post-processing unit 40 also has a second sheet-transport path R2 that is split off from the first sheet-transport path R1 at a first split portion B1 and transports the sheet P to the second stack portion 45, and a third sheet-transport path R3 that is split off from the first sheet-transport path R1 at a second split portion B2 and transports the sheet P to the saddle-stitch unit 44. In this exemplary embodiment, the second split portion B2 is located downstream of the first split portion B1 in a sheet-transport direction in the first sheet-transport path R1.

In this exemplary embodiment, a switching gate 70, which is an example of a switching member, is provided. The switching gate 70 is disposed between the first split portion B1 and the second split portion B2 and switches (sets) the sheet-transportation destination among the first sheet-transport path R1 to the third sheet-transport path R3. This switching gate 70 projects above the first sheet-transport path R1, at a predetermined position downstream of the first split portion B1 and upstream of the second split portion B2. Thus, the switching gate 70 guides the sheet P transported downstream along the first sheet-transport path R1 to the second sheet-transport path R2 and guides the sheet P transported upstream along the first sheet-transport path R1 to the third sheet-transport path R3 (a detailed description will be given below).

The switching gate 70 has a first guide surface 75 and a second guide surface 76, which is on the other side of the first guide surface 75. A sheet P transported downstream along the first sheet-transport path R1 is guided to the second sheet-transport path R2 by the first guide surface 75, and a sheet P transported upstream along the first sheet-transport path R1 is guided to the third sheet-transport path R3 by the second guide surface 76 (a detailed description will be given below). The switching gate 70 is retractable from the first sheet-transport path R1. When a sheet P is transported to the side-stitch stapler unit 42, the switching gate 70 is retracted from the first sheet-transport path R1.

In this exemplary embodiment, a gate driving mechanism 71 having a motor to drive the switching gate 70 is provided. Transport rollers 90, each including a pair of rotatable roller members, are provided on the first sheet-transport path R1 to the third sheet-transport path R3 to transport the sheet P on the sheet-transport paths. Furthermore, although not shown in FIG. 2, sheet guide members that extend along the first sheet-transport path R1 to the third sheet-transport path R3 to guide the sheet P transported along these sheet-transport paths are arranged beside the first sheet-transport path R1 to the third sheet-transport path R3.

The perforation unit 41 is provided next to the introduction port 49 and perforates (punches) a sheet P transported to the first post-processing unit 40 to make some (e.g., two, four, etc.) holes. The perforation unit 41 has a unit body 411 that has a perforating blade to make some (e.g., two, four, etc.) holes in the sheet P, and a container 412 disposed below the unit body 411 to store punching waste resulting from the perforation performed by the unit body 411. The perforation unit 41 also has a partition wall 413 provided between the container 412 and the inside of the first post-processing unit 40 to partition the area where the container 412 is disposed and the inside of the first post-processing unit 40.

Next, the side-stitch stapler unit 42 will be described. The side-stitch stapler unit 42 includes a sheet collecting portion 60 that has a support plate 67, which is obliquely disposed and supports sheets P from below, and collects a necessary number of sheets P to form a sheet stack P; a binding portion 50 that binds an end of the sheet stack P, formed by the sheet collecting portion 60, with a staple (side stitch); a transport roller 61 that transports the sheet stack P, formed by the sheet collecting portion 60, to the first stack portion 43; and a movable roller 62 that may be moved to a position retracted from the transport roller 61 and to a position where it is pressed against the transport roller 61.

When the side-stitch stapler unit 42 performs processing, first, the sheet P transported from the folding unit 30 (see FIG. 1) is introduced from the introduction port 49. Then, the sheet P is transported along the first sheet-transport path R1 to the side-stitch stapler unit 42. The sheet P is transported to a position above the support plate 67 and is dropped onto the support plate 67. The sheet P is supported by the support plate 67 from below and slides on the support plate 67 due to the inclination of the support plate 67.

Then, the sheet P comes into contact with end guides 64 attached to an end of the support plate 67. More specifically, in this exemplary embodiment, the end guides 64 extending upward in FIG. 2 are provided at the end of the support plate 67. The sheet P slides on the support plate 67 and comes into contact with the end guides 64. Thus, in this exemplary embodiment, the movement of the sheet P is stopped. This operation is performed every time a sheet P is transported from the upstream side, and a sheet stack P, in which the trailing ends of sheets P are aligned, is formed on the support plate 67.

In this exemplary embodiment, a rotary paddle 63 that moves the sheet P on the support plate 67 to the end guides 64 is provided. The sheet P moves to the end guides 64 due to the inclination of the support plate 67 and the rotary paddle 63. Furthermore, in this exemplary embodiment, sheet-width-position adjusting members 65 that adjust the position of the sheet stack P in the width direction are provided. In this exemplary embodiment, each time the sheet P is supplied onto the support plate 67, ends (side portions) of the sheet P in the width direction are pressed by the sheet-width-position adjusting members 65 so that the positions, in the width direction, of the sheet P (sheet stack P) are adjusted.

Once a predetermined number of sheets P are stacked on the support plate 67, an end of the sheet stack P is stapled by a stapler head 51 provided in the binding portion 50. The stapler head 51 performs stapling by inserting a metal staple (a U-shaped wire) into the sheet stack P. Then, in this exemplary embodiment, the movable roller 62 advances toward the transport roller 61 to pinch the sheet stack P between the movable roller 62 and the transport roller 61. Then, the transport roller 61 is rotated to transport the sheet stack P to the first stack portion 43.

Figure 3:
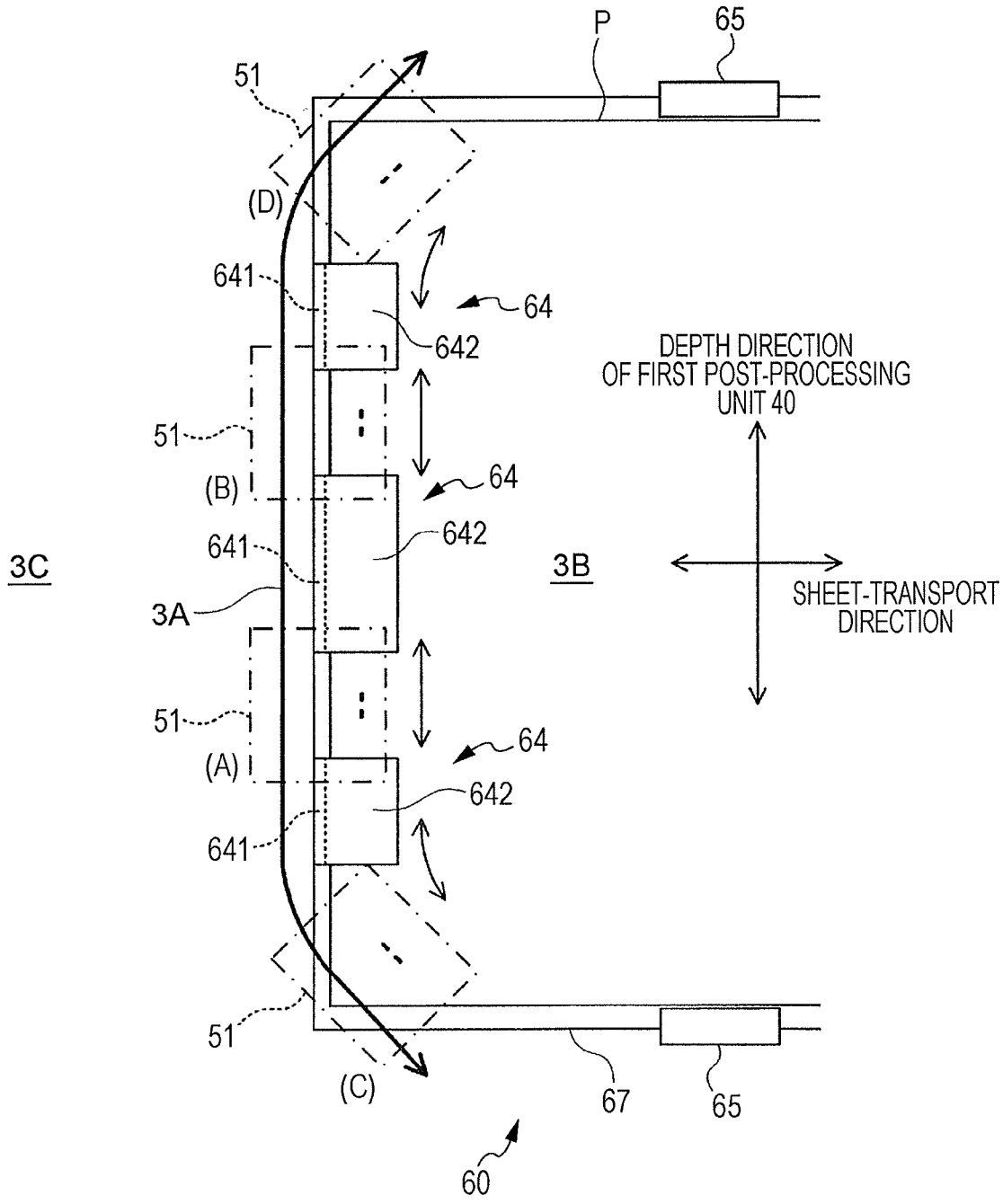
FIG. 3 illustrates the movement of a stapler head when a sheet collecting portion is viewed from above.

As illustrated in FIG. 3, which shows the movement of the stapler head 51 when the sheet collecting portion 60 is viewed from above, the stapler head 51, which is an example of a biding mechanism, is movable toward the far side and the near side of the first post-processing unit 40 in FIG. 3 (i.e., is movable from the near side to the far side of the first post-processing unit 40 in FIG. 3, along a predetermined movement path 3A). In this exemplary embodiment, the sheets P may be bound at several positions. More specifically, in this exemplary embodiment, the stapler head 51 moves in a depth direction of the first post-processing unit 40, which is a direction perpendicular to the sheet-transport direction (sheet-stack-transport direction), and binds the sheet stack P at several different positions.

Furthermore, as illustrated in FIG. 3, the stapler head 51 according to this exemplary embodiment stops at, for example, two different positions (position (A) and position (B) in FIG. 3) in the depth direction of the first post-processing unit 40 and performs binding at the two positions (two-point side stitch). The stapler head 51 also stops at, for example, an end of the sheet stack P (a corner of the sheet stack P: position (D) in FIG. 3) and performs binding (one-point side stitch).

The stapler head 51 stops at, for example, the other end of the sheet stack P (the other corner of the sheet stack P: position (C) in FIG. 3) and performs binding (one-point side stitch). In this exemplary embodiment, the stapler head 51 moves in a straight line between position (A) and position (B). The stapler head 51 moves with an angle of rotation of, for example, 45°, between position (A) and position (C) and between position (B) and position (D).

As illustrated in FIG. 3, in this exemplary embodiment, several end guides 64 are provided. The end guides 64 are arranged at different positions in the depth direction of the first post-processing unit 40 (the direction perpendicular to the sheet-transport direction). As illustrated in FIG. 3, the end guides 64 each include a restriction portion 641 that is perpendicular to the support plate 67 and that receives ends of sheets P to restrict the movement of the sheets P, and a facing plate 642 that is connected to the restriction portion 641 and faces the support plate 67. In this exemplary embodiment, when the sheets P are stacked on the support plate 67, the ends of the sheets P enter a space between the facing plate 642 and the support plate 67 and come into contact with the restriction portion 641. Thus, the sheets P are aligned.

When the stapler head 51 performs binding at position (A) in FIG. 3, binding is performed in a space between the facing plate 642 located at the center (in the top-bottom direction) and the facing plate 642 located at the lower part in FIG. 3. When the stapler head 51 performs binding at position (B) in FIG. 3, binding is performed in a space between the facing plate 642 located at the center and the facing plate 642 located at the upper part in FIG. 3.

Next, referring back to FIG. 2, the saddle-stitch unit 44 will be described. As illustrated in FIG. 2, the saddle-stitch unit 44 includes a sheet collecting portion 441 that is inclined with respect to the perpendicular direction and functions as a part of a recording-material-stack forming unit that forms a sheet stack P by collecting a necessary number of sheets P after image formation; an output roller 442 for outputting the sheet P, transported via the third sheet-transport path R3, onto the sheet collecting portion 441; an end guide 443 that moves along the sheet collecting portion 441 to determine the saddle-stitch position or the half-folding position; and sheet alignment members (not shown) that transport the sheets P collected in the sheet collecting portion 441 toward the end guide 443. The sheet alignment members are formed of rotating paddles.

The saddle-stitch unit 44 further includes a sheet-width alignment member 445 formed of a pair of matching plates that are slid to align the sheets P collected in the sheet collecting portion 441 in the width direction; a stapler 446 that performs saddle-stitching on the sheet stack P collected in the sheet collecting portion 441; a folding knife 447 that advances from the back to the front of the sheet collecting portion 441 to fold, at the center, the sheet stack P, which has been saddle-stitched by the stapler 446; folding rollers 448 including a pair of rollers that nip the sheet stack P, which begins to be folded by the folding knife 447, therebetween; and transport rollers 449 that transport the sheet stack P, nipped between the folding rollers 448, to the second post-processing unit 500.

When a half-folded, saddle-stitched book is produced in the first post-processing unit 40, first, the introduction port 49 receives a sheet P. This sheet P is transported along the first sheet-transport path R1 until the trailing end of the sheet P reaches the switching gate 70. At this time, the switching gate 70 is arranged to guide the sheet P to the first sheet-transport path R1 (side-stitch stapler unit 42). After the trailing end of the sheet P reaches the switching gate 70, transportation of the sheet P is temporarily stopped.

Then, the switching gate 70 is driven to press the trailing end of the sheet P from the side, and the trailing end of the sheet P enters the third sheet-transport path R3. Then, reverse rotation of the transport rollers 90 (transport rollers 90A: hereinbelow, "forward-reverse rollers 90A") is started. As a result, the sheet P starts to be transported along the third sheet-transport path R3 and is guided to the output roller 442 provided in the saddle-stitch unit 44. Then, the sheet P is sent to the sheet collecting portion 441 by the output roller 442. This operation is repeated every time a new sheet P is transported.

As a result, a predetermined number (e.g., five, ten, and fifteen) of sheets set in, for example, the controller of the image forming apparatus 2 (not shown) are collected in the sheet collecting portion 441. When the sheets P are collected in the sheet collecting portion 441, the sheet alignment members (not shown) are rotated to press the collected sheets P against the end guide 443, thereby helping sheet alignment. The sheet-width alignment member 445 slides in the width direction of the sheets P collected in the sheet collecting portion 441 to align the collected sheets P in the width direction.

Depending on the size of the sheets P, after a predetermined number of sheets P are collected in the sheet collecting portion 441, the end guide 443 moves upward to position the middle portion of the sheets P (the sheet stack P) at the staple position of the stapler 446. At this time, although the sheet stack P brought upward by the end guide 443 moves upward along the sheet collecting portion 441, when the sheet stack P is long, the sheet stack P moves along a dashed line 3A in FIG. 2.

In this case, the leading end of the sheet stack P may come into contact with the perforation unit 41, and the movement of the sheet stack P may be restricted. However, in this exemplary embodiment, owing to the partition wall 413 provided in the perforation unit 41, the sheet stack P is guided to the path beside the perforation unit 41, and the movement of the sheet stack P is not restricted. The partition wall 413 may be omitted, and the sheet stack P may be guided to the path beside the perforation unit 41 with the side surface of the container 412.

When the middle portion of the sheet stack P reaches the staple position of the stapler 446, saddle-stitching is performed on the sheet stack P by the stapler 446. Next due to the end guide 443 moving downward, the saddle-stitched sheet stack P is moved such that the folded part (the middle portion of the sheet stack P) is aligned with the tip of the folding knife 447. The folding knife 447 is retracted behind the sheet collecting portion 441 while the sheets are collected in the sheet collecting portion 441, the stapler 446 are performing the saddle-stitching, and the sheets are transported after the saddle-stitching.

After the folded portion of the sheet stack P is moved to the position of the tip of the folding knife 447, the folding knife 447 is pushed from the back to the front of the sheet collecting portion 441. The folding knife 447 projects toward the front of the sheet collecting portion 441 through an opening (not shown) provided in the sheet collecting portion 441. Because of this, the middle portion of the sheet stack P is pushed toward the folding rollers 448 and is nipped between the folding rollers 448. Then, the sheet stack P is transported downstream by the folding rollers 448 and is transferred to the transport rollers 449. Then, the half-folded and saddle-stitched sheet stack P is delivered to the second post-processing unit 500 by the transport rollers 449.

Although binding with the side-stitch stapler unit 42 and half-folding and saddle-stitching with the saddle-stitch unit 44 have been described in the description above, a sheet P that is not subjected to such processing (i.e., a sheet P that is not processed in the first post-processing unit 40) or a sheet P that is just perforated by the perforation unit 41 is guided to the first guide surface 75 of the switching gate 70 by the second sheet-transport path R2 and is stacked on the second stack portion 45.

Figure 4:
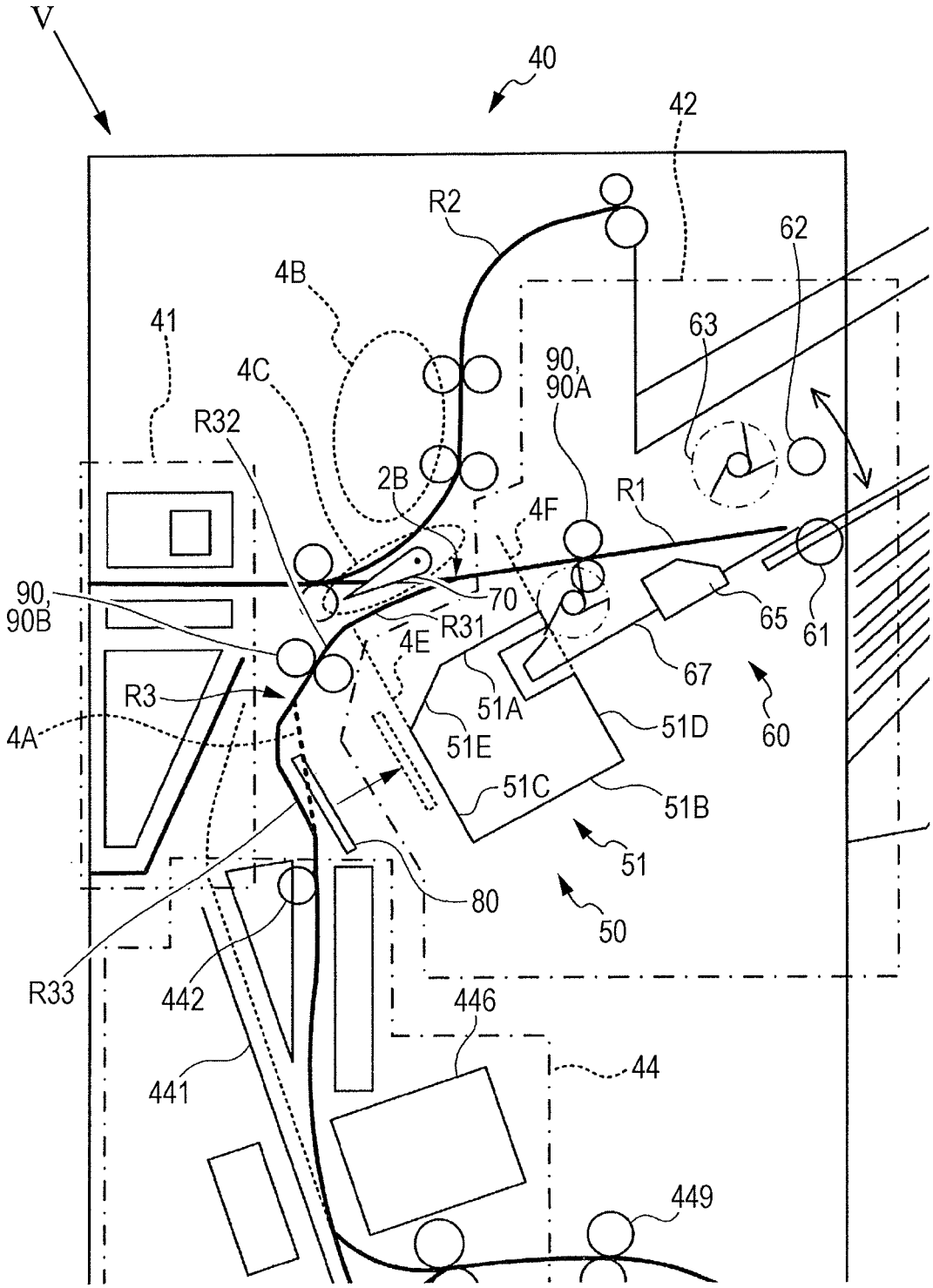
FIG. 4 is an enlarged view of an upper part of the first post-processing unit.

Referring to FIG. 4 (an enlarged view of the upper part of the first post-processing unit 40), the first post-processing unit 40 will be further described. The support plate 67 provided in the sheet collecting portion 60 is disposed at an angle of 30° with respect to the horizontal plane (not shown). Furthermore, in this exemplary embodiment, the sheet collecting portion 441 provided in the saddle-stitch unit 44 is disposed at an angle of 20° to 30° with respect to the vertical surface (not shown: a surface extending in the perpendicular direction). Thus, in this exemplary embodiment, the support plate 67 and the sheet collecting portion 441 are arranged perpendicular to each other. When the support plate 67 and the sheet collecting portion 441 are arranged perpendicular to each other like this, a wasted space is reduced compared with the case where the support plate 67 and the sheet collecting portion 441 are not perpendicular to each other, and hence, the size of the first post-processing unit 40 is reduced.

Now, the stapler head 51 will be described in detail. As illustrated in FIG. 4, the stapler head 51 has a rectangular shape in side view. The stapler head 51 includes a top surface 51A, a bottom surface 51B, a first side surface 51C located near the third sheet-transport path R3, and a second side surface 51D facing the first side surface 51C. An oblique surface 51E that meets the top surface 51A and the first side surface 51C is provided at a position where the top surface 51A is to meet the first side surface 51C.

In this exemplary embodiment, by arranging the third sheet-transport path R3 near the outer surface of the stapler head 51 as much as possible, a wasted space between the third sheet-transport path R3 and the stapler head 51 is reduced, thereby achieving a reduction in size of the first post-processing unit 40. Furthermore, by arranging the third sheet-transport path R3 along the outer surface of the stapler head 51, the size of the first post-processing unit 40 is reduced. If the third sheet-transport path R3 is not arranged along the outer surface of the stapler head 51, and a part of the third sheet-transport path R3 is located away from the outer surface of the stapler head 51, a wasted space may be produced, making it difficult to reduce the size of the first post-processing unit 40.

More specifically, in this exemplary embodiment, as illustrated in FIG. 4, a first straight path R31 extending straight from the second split portion B2 toward the downstream side is provided in the third sheet-transport path R3. The first straight path R31 is provided along the top surface 51A of the stapler head 51. More specifically, in this exemplary embodiment, the top surface 51A of the stapler head 51 moves over the virtual plane as the stapler head 51 moves. The first straight path R31 is provided along this virtual plane.

Furthermore, in this exemplary embodiment, a second straight path R32 connected to the first straight path R31 and extending straight from the joint to the first straight path R31 toward the downstream side is provided in the third sheet-transport path R3. The second straight path R32 is provided along the oblique surface 51E of the stapler head 51 (a virtual plane along which the oblique surface 51E moves). Furthermore, in this exemplary embodiment, a third straight path R33 extending straight and disposed downstream of the second straight path R32 is provided in the third sheet-transport path R3. The third straight path R33 is provided along the first side surface 51C of the stapler head 51 (a virtual plane along which the first side surface 51C moves).

In this manner, in this exemplary embodiment, the third sheet-transport path R3 is formed of several straight paths arranged along the outer surface of the stapler head 51. With this configuration, the space between the stapler head 51 and the third sheet-transport path R3 is reduced, whereby the size of the first post-processing unit 40 is reduced. Furthermore, in this exemplary embodiment, the part of the third sheet-transport path R3 surrounding the stapler head 51 is not formed of a curved path, but is formed of several straight paths. Thus, a wasted space, which may be more likely to be produced when the third sheet-transport path R3 is formed of a curved path, is less likely to be produced.

Next, the sheet guide members will be described in detail. In this exemplary embodiment, as described above, beside the first sheet-transport path R1 to the third sheet-transport path R3, the sheet guide members that guide a sheet P guided along these sheet-transport paths are provided. In this exemplary embodiment, some of the sheet guide members may be moved in a direction away from the sheet-transport paths. This allows a user to access the sheet-transport paths and remove a sheet P stopped due to a paper jam etc.

More specifically, in this exemplary embodiment, as illustrated in FIG. 4, a part of the sheet guide member provided along the third sheet-transport path R3 (the sheet guide member denoted by reference numeral 80 in FIG. 4: hereinbelow, a "sheet guide member 80") is rotatable about a hinge provided at the far side of the first post-processing unit 40. By rotating the sheet guide member 80, an opening is formed, allowing a user to access the third sheet-transport path R3. Thus, a sheet P stopped due to a paper jam etc may be removed. Although the first post-processing unit 40 includes several sheet guide members, FIG. 4 illustrates only the sheet guide member 80. Illustration of the sheet guide members other that the sheet guide member 80 is omitted.

Figure 5:
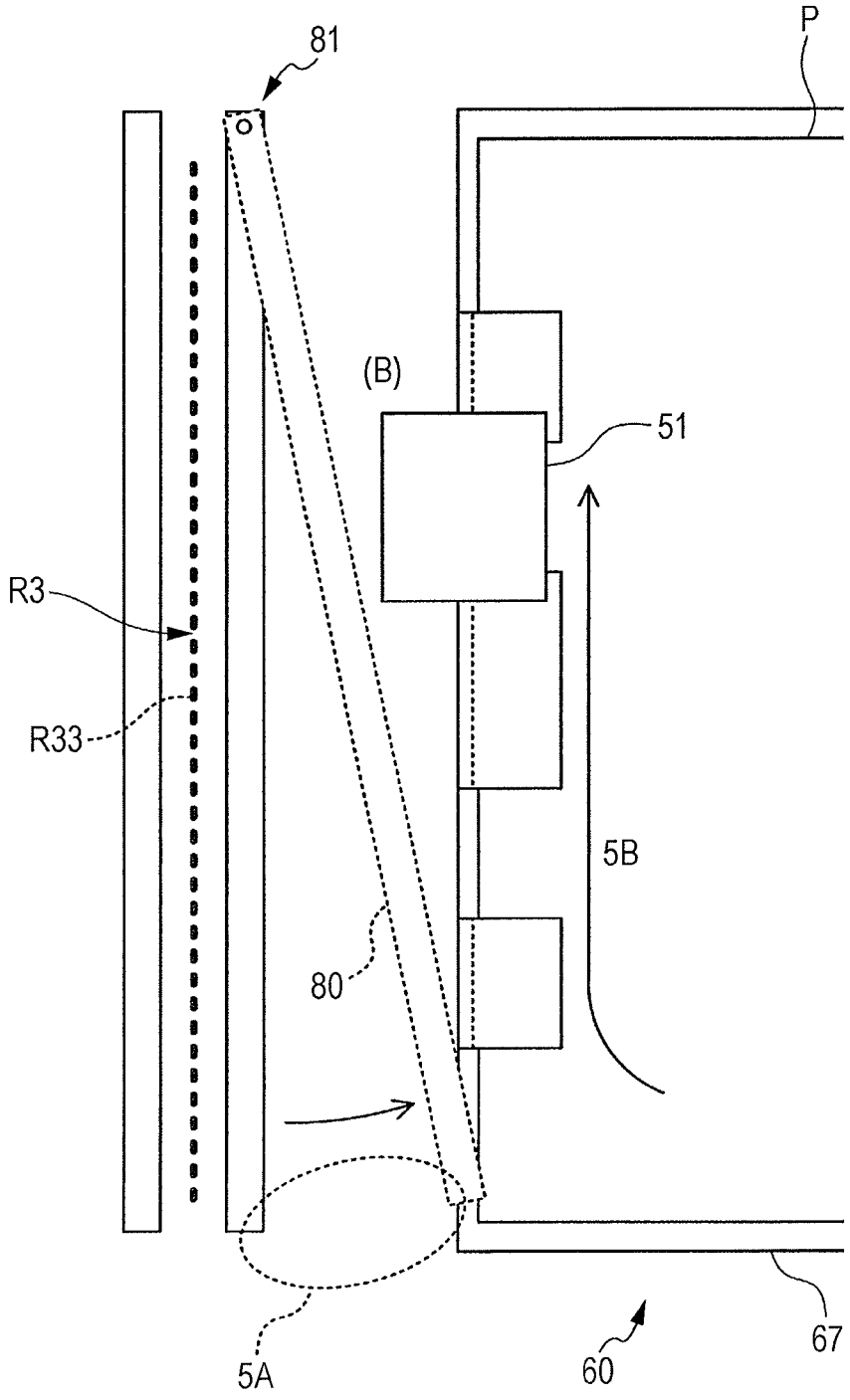
FIG. 5 is a diagram for explaining a sheet guide member.

Referring to FIG. 5 (a diagram for explaining the sheet guide member 80), a more detailed description of the sheet guide member 80 will be given. FIG. 5 illustrates the sheet guide member 80, the sheet collecting portion 60, etc., as viewed in an arrow V direction in FIG. 4. As described above and as illustrated in FIG. 5, the sheet guide member 80 may be rotated about a hinge 81 disposed at the far side of the first post-processing unit 40. When the sheet guide member 80 is rotated about the hinge 81 in a direction away from the third sheet-transport path R3 (third straight path R33), an opening is formed at a position denoted by reference numeral 5A in FIG. 5. Thus, a user becomes able to access the third sheet-transport path R3 from the front of the first post-processing unit 40 through this opening.

In this exemplary embodiment, when a paper jam is detected by a sensor (not shown), the stapler head 51 automatically moves to position (B), as indicated by an arrow 5B in FIG. 5. Then, the occurrence of a paper jam is notified to the user. Then, the sheet guide member 80 becomes able to be widely opened, providing a wide opening.

In this exemplary embodiment, as described above, a part of the third sheet-transport path R3 is formed by connecting three straight paths, namely, the first straight path R31 to the third straight path R33. As illustrated in FIG. 4, as a whole, the part formed of the first straight path R31 to the third straight path R33 curves leftward toward the downstream side in the sheet-transport direction. In this exemplary embodiment, the sheet guide member 80 is provided radially inward of the curved portion in the third sheet-transport path R3.

Figure 6:
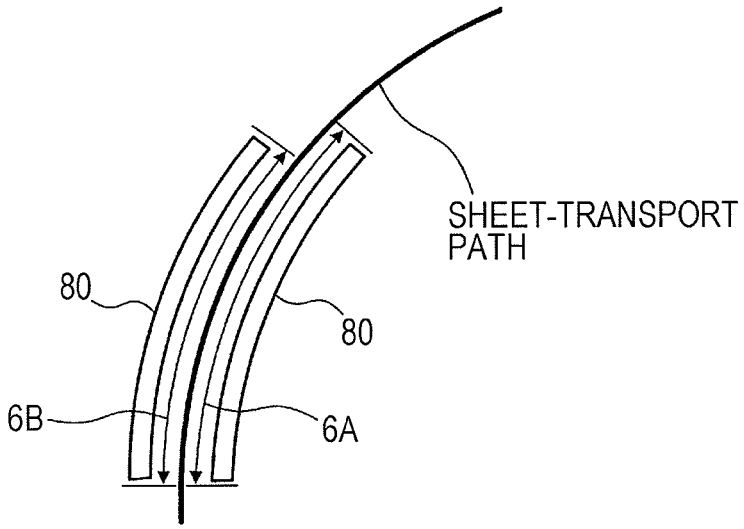
FIG. 6 illustrates an exemplary arrangement of the sheet guide member.

As illustrated in FIG. 6 (a diagram showing an exemplary arrangement of the sheet guide member 80), when sheet guide members 80 of the same size are provided radially outward and inward of a curved sheet-transport path, typically, the sheet guide member 80 provided radially inward is configured to be openable to increase the area to which the user may access.

More specifically, when the sheet guide member 80 provided radially inward is opened, a user may access an area denoted by reference numeral 6A in FIG. 6, whereas when the sheet guide member 80 provided on the radially outer side is opened, the user may access an area denoted by reference numeral 6B, which is smaller than the area 6A. Hence, in this exemplary embodiment, as described above, the sheet guide member 80 is provided radially inward of the curved portion of the third sheet-transport path R3 to increase the area to which the user may access.

Furthermore, in this exemplary embodiment, as described above, the third straight path R33 (see FIG. 4) is provided along the first side surface 51C of the stapler head 51. This configuration further increases the size of the opening formed due to the sheet guide member 80 being rotated in this exemplary embodiment.

For example, if the third straight path R33 is not straight but is curved so as to be convex toward the stapler head 51, or if the third straight path R33 is not arranged along the first side surface 51C, as indicated by dashed line 4A in FIG. 4, the angle of rotation of the sheet guide member 80 is small, so the opening is also small. Although the size of the opening may be increased by increasing the distance between the third straight path R33 and the stapler head 51, this may make it difficult to reduce the size of the first post-processing unit 40. In contrast, when the third straight path R33 having a straight shape is arranged along the first side surface 51C as in this exemplary embodiment, the size of the opening may be increased while reducing the size of the first post-processing unit 40.

Furthermore, in this exemplary embodiment, when the sheet guide member 80 is operated by the user, the stapler head 51 is located at position (B) in FIG. 5. As a result, in this exemplary embodiment, a space for opening the sheet guide member 80 is produced in the first post-processing unit 40. Usually, nothing is disposed in the path of the stapler head 51, so a wasted space is produced. However, in this exemplary embodiment, the sheet guide member 80 is opened in the path of the stapler head 51 and reaches the path of the stapler head 51 to utilize the wasted space. Thus, the size of the first post-processing unit 40 is further reduced.

In this exemplary embodiment, a sheet guide member (not shown) that moves in a direction away from the second sheet-transport path R2 is provided in an area 4B in FIG. 4. The sheet P on the second sheet-transport path R2 may be removed also in this area. In this exemplary embodiment, when a sheet P is jammed at a position downstream of the sheet guide member 80 or at a position downstream of the area 4B, the jammed sheet P is transported to the sheet guide member 80 or to the area 4B.

More specifically, paper jam is often caused due to the leading end of a sheet P interfering with something, and even when paper jam occurs, the sheet P is often able to be transported to the upstream side. Hence, in this exemplary embodiment, as described above, when a sheet P is jammed at a position downstream of the sheet guide member 80 or at a position downstream of the area 4B, this sheet P is transported to the sheet guide member 80 or to the area 4B. Then, this sheet P is removed by a user.

Referring back to FIG. 4, the first post-processing unit 40 will be further described. In this exemplary embodiment, in order to reduce the size of the first post-processing unit 40, the transport rollers 90 are also provided at positions contributing to a reduction in size of the first post-processing unit 40. More specifically, the transport rollers 90 are disposed at a position away from a facing area that faces the top surface 51A of the stapler head 51 (a virtual plane along which the top surface 51A moves). More specifically, the transport rollers 90 are disposed at a position away from an area located between a virtual plane extending from the first side surface 51C (a plane 4E) and a virtual plane extending from the second side surface 51D (a plane 4F).

More specifically, first, the forward-reverse rollers 90A are disposed at a position away from the facing area. Furthermore, the forward-reverse rollers 90A are disposed downstream of the facing area in the sheet-transport direction in the first sheet-transport path R1. Furthermore, in this exemplary embodiment, the transport rollers 90 disposed in the third sheet-transport path R3, at a position between the switching gate 70 and the output roller 442, (hereinbelow, a "third-path transport rollers 90B") are also provided at a position away from the facing area. More specifically, the third-path transport rollers 90B are disposed downstream of the facing area in the sheet-transport direction in the third sheet-transport path R3.

Furthermore, in this exemplary embodiment, the sheet-transport path along which the sheet P is transported when the sheet P is transported to the saddle-stitch unit 44 (i.e., the sheet-transport path located between the forward-reverse rollers 90A and the saddle-stitch unit 44; hereinbelow also referred to as a "saddle-stitch path") is formed so as to extend from an area 3B to an area 3C in FIG. 3, which face each other with the movement path 3A therebetween (see FIG. 3). Furthermore, this saddle-stitch path is provided beside the movement path 3A, along which the stapler head 51 moves (in FIG. 4, a portion located between the plane 4E and the plane 4F).

In this exemplary embodiment, the forward-reverse rollers 90A, which serve as the first transport member, are disposed in the area 3B, and the third-path transport rollers 90B, which serve as the second transport member, are disposed in the area 3C. Furthermore, in this exemplary embodiment, the forward-reverse rollers 90A and the third-path transport rollers 90B are provided at portions different from the above-mentioned position provided beside the movement path 3A in the saddle-stitch path (i.e., the portion located between the plane 4E and the plane 4F in FIG. 4).

As has been described, in this exemplary embodiment, the transport rollers 90 are provided at a position away from the facing area that faces the top surface 51A of the stapler head 51. Hence, in this exemplary embodiment, a part of the first sheet-transport path R1 (the part between the second split portion B2 and the forward-reverse rollers 90A) may be disposed near the top surface 51A of the stapler head 51, and a part of the third sheet-transport path R3 (the part between the second split portion B2 and the third-path transport rollers 90B) may be disposed near the top surface 51A of the stapler head 51. More specifically, a part of the saddle-stitch path may be disposed near the top surface 51A of the stapler head 51. In this case, the size of the first post-processing unit 40 may be further reduced.

When the transport rollers 90 are provided in the facing area, in order to avoid interference between the transport rollers 90 and the stapler head 51, the transport rollers 90 have to be provided at a position away from the stapler head 51. In such a case, the distance between the top surface 51A of the stapler head 51 and the sheet-transport paths (first sheet-transport path R1 and the third sheet-transport path R3) is larger than that illustrated in FIG. 4, leading to an increase in size of the first post-processing unit 40.

Furthermore, in this exemplary embodiment, because the sheet-transport path may be provided near the top surface 51A of the stapler head 51, a space is produced in an opposite area of the sheet-transport path from the stapler head 51 (area 4C in FIG. 4). In this exemplary embodiment, the switching gate 70 is disposed in this area. More specifically, in this exemplary embodiment, as described above, the saddle-stitch path extends beside the movement path 3A, along which the stapler head 51 moves. Furthermore, in this exemplary embodiment, the switching gate 70 is provided on the opposite side of the part of the saddle-stitch path extending beside the movement path 3A from the movement path 3A. Accordingly, in this exemplary embodiment, the limited space in the first post-processing unit 40 is further efficiently used, and the size of the first post-processing unit 40 is further reduced.

Figure 7:
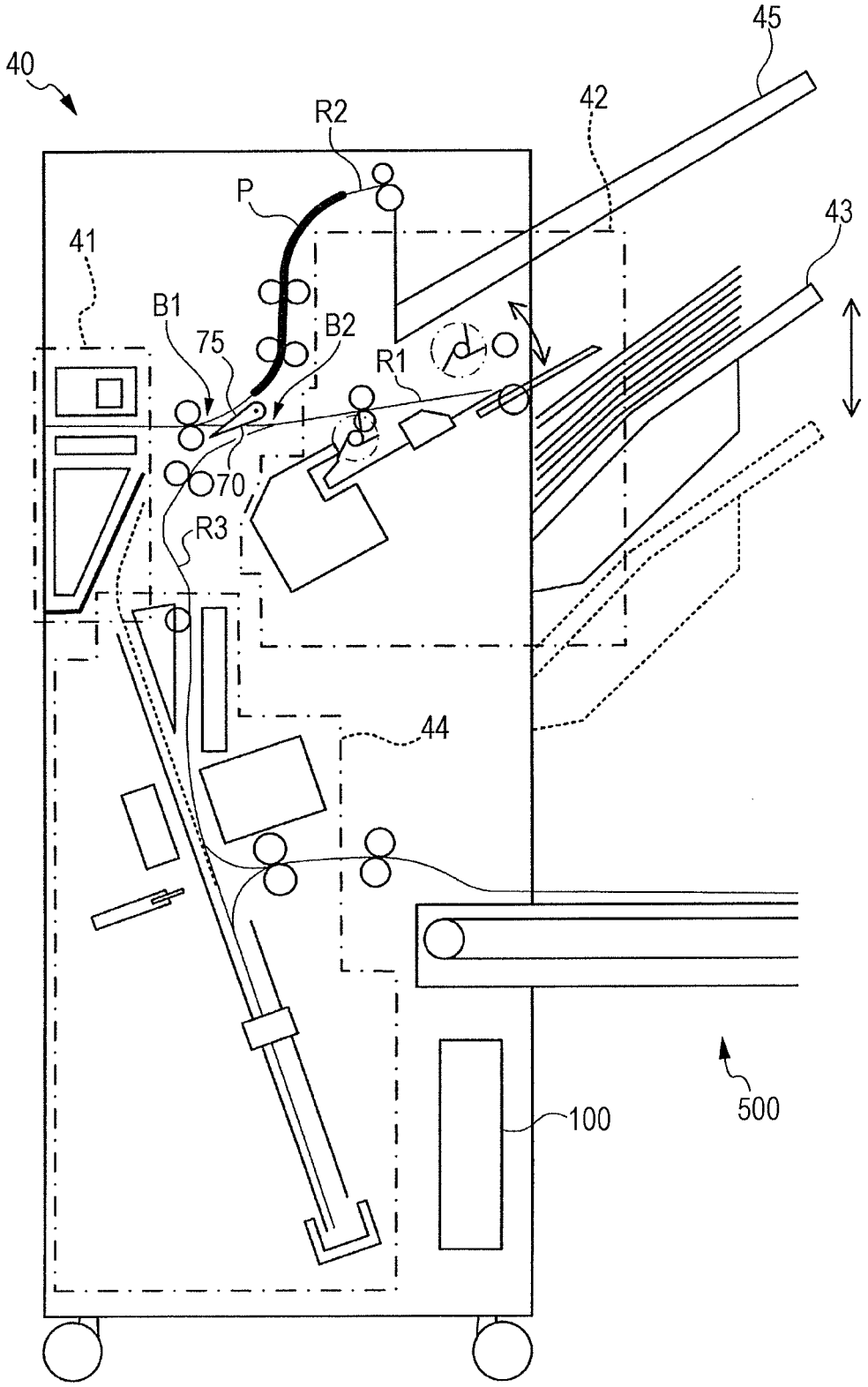
FIG. 7 is a diagram for explaining the movement when a sheet is transported to a second stack portion.

Now, the movement of the first post-processing unit 40 will be described. First, referring to FIG. 7, which illustrates the movement when a sheet P is transported to the second stack portion 45, movements of the respective parts when the sheet P is transported to the second stack portion 45 will be described. As described above, a sheet P that is not processed in the first post-processing unit 40 or a sheet P that is only perforated in the perforation unit 41 is guided to the second sheet-transport path R2 by the first guide surface 75 of the switching gate 70 and is stacked on the second stack portion 45. In this case, as illustrated in FIG. 7, the switching gate 70 is arranged so as to cross the first sheet-transport path R1. The sheet P transported from the upstream side along the first sheet-transport path R1 is guided to the second sheet-transport path R2. Then, the sheet P is stacked on the second stack portion 45.

Figure 8:
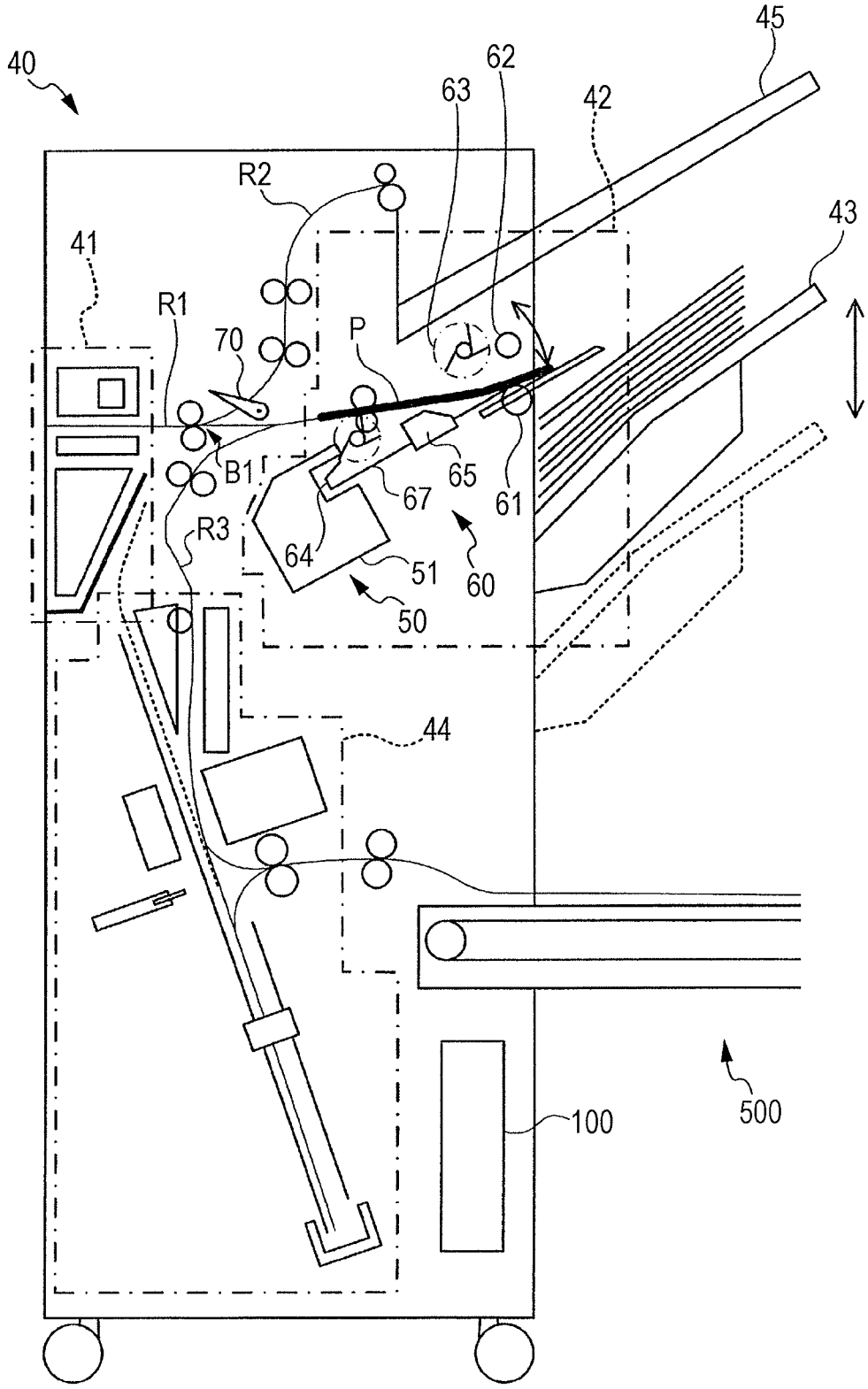
FIG. 8 is a diagram for explaining the movement when a sheet is transported to a side-stitch stapler unit.

Next, referring to FIG. 8, which illustrates the movement when a sheet P is transported to the side-stitch stapler unit 42, movements of the respective parts when the sheet P is transported to the side-stitch stapler unit 42 will be described. When a sheet P is transported to the side-stitch stapler unit 42, as illustrated in FIG. 8, the switching gate 70 is retracted from the first sheet-transport path R1. In this case, the sheet P transported to the switching gate 70 along the first sheet-transport path R1 passes through a portion where the switching gate 70 is provided (a position where the switching gate 70 projects) and is further transported along the first sheet-transport path R1. Then, the sheet P reaches the side-stitch stapler unit 42.

Figure 9:
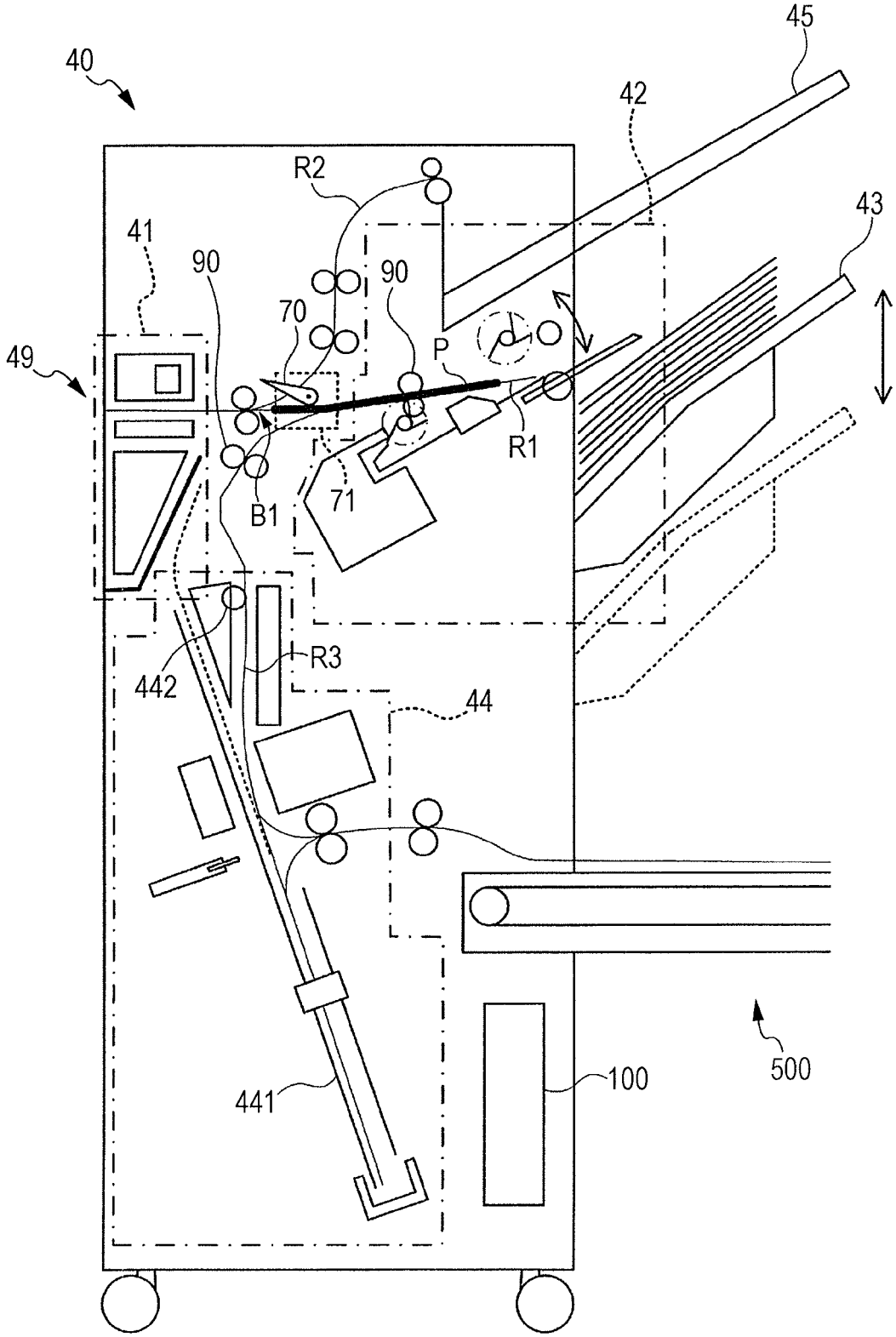
FIG. 9 is a diagram for explaining the movement when a sheet is transported to a saddle-stitch unit.

Next, referring to FIGS. 9 to 11, which illustrate the movement when a sheet P is transported to the saddle-stitch unit 44, movements of the respective parts when the sheet P is transported to the saddle-stitch unit 44 will be described. When a sheet P is transported to the saddle-stitch unit 44, the sheet P is received by the introduction port 49 and is transported along the first sheet-transport path R1. At this time, as illustrated in FIG. 9, the switching gate 70 is retracted from the first sheet-transport path R1. Then, as illustrated in FIG. 9, the sheet P is transported until the trailing end of the sheet P reaches the switching gate 70. After the trailing end of the sheet P reaches the switching gate 70, transportation of the sheet P is temporarily stopped.

Figure 10:
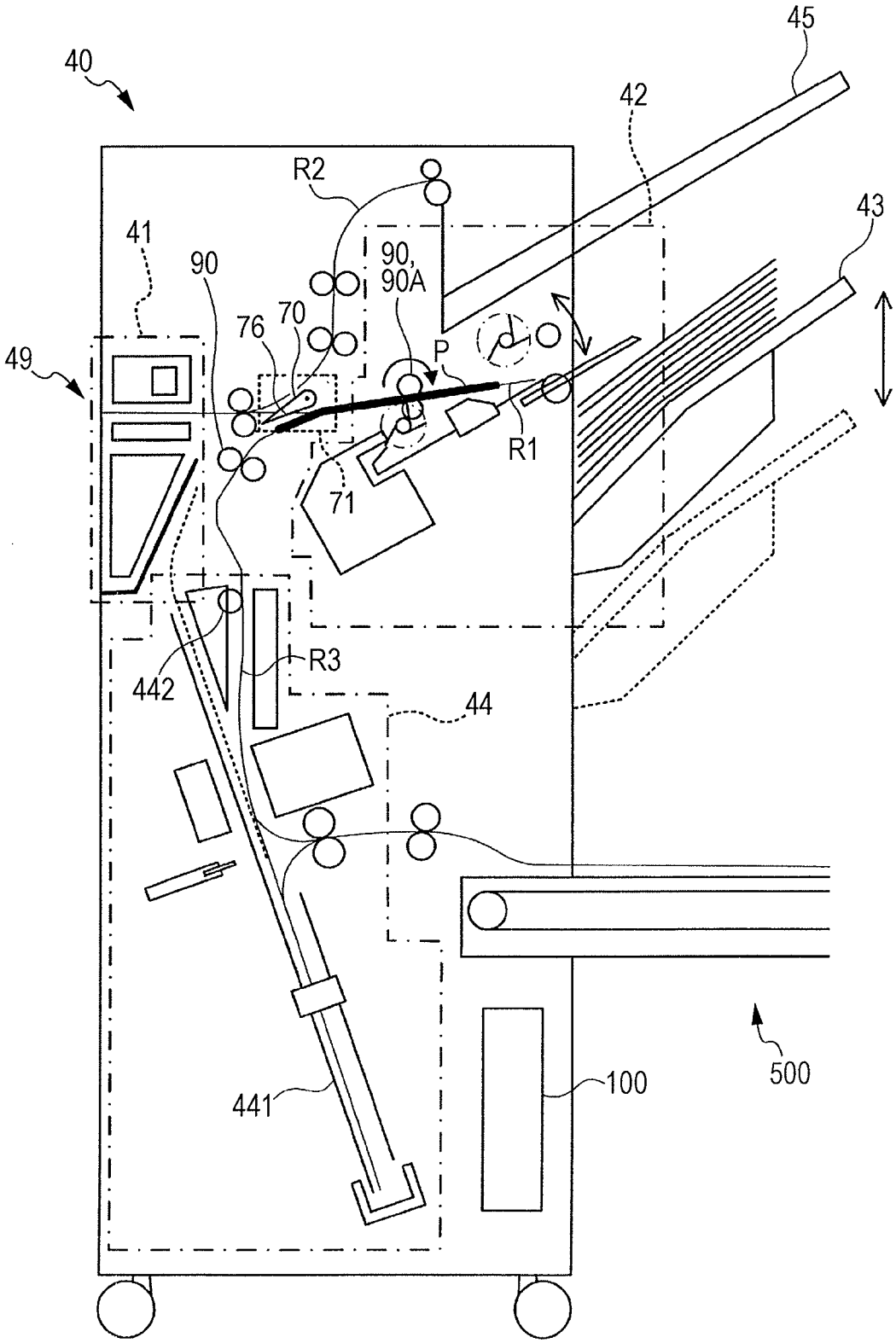
FIG. 10 is a diagram for explaining the movement when a sheet is transported to the saddle-stitch unit.
Figure 11:
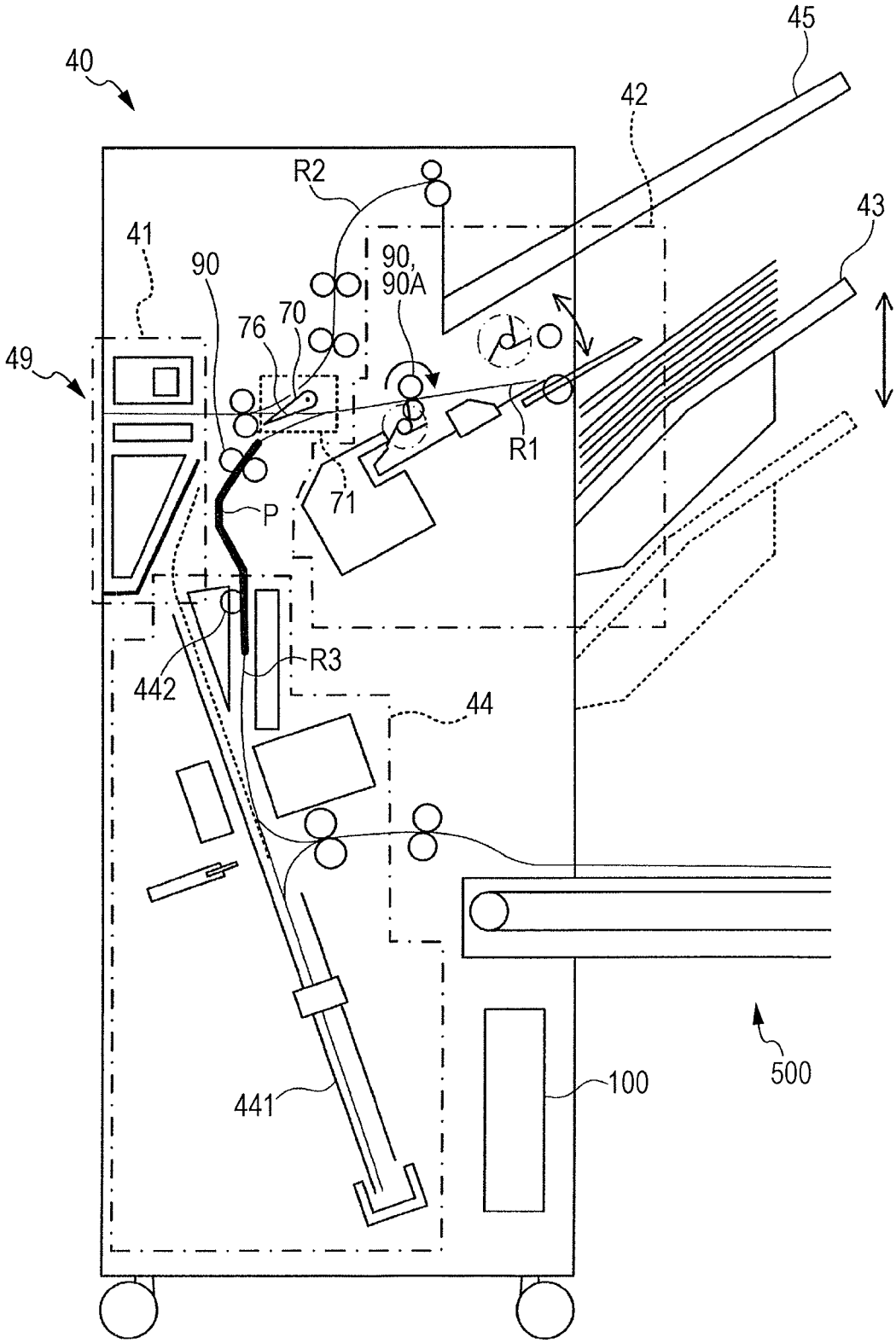
FIG. 11 is a diagram for explaining the movement when a sheet is transported to the saddle-stitch unit.

Next, the gate driving mechanism 71 is driven, and as illustrated in FIG. 10, the switching gate 70 is arranged so as to cross the first sheet-transport path R1. As a result, the trailing end of the sheet P is pressed from the side by the second guide surface 76 of the switching gate 70 and enters the third sheet-transport path R3. Then, reverse rotation of the forward-reverse rollers 90A is started. As a result, the sheet P transported along the first sheet-transport path R1 in one direction is transported in the opposite direction, is guided by the second guide surface 76 of the switching gate 70, and is sent to the third sheet-transport path R3, as illustrated in FIG. 11. Then, the sheet P is transported to the output roller 442 provided in the saddle-stitch unit 44 and is sent to the sheet collecting portion 441 by the output roller 442.

When the sheet P has been transported to the third sheet-transport path R3 by the reversely rotating forward-reverse rollers 90A, the switching gate 70 is retracted from the first sheet-transport path R1 to allow a next sheet P to pass. When the trailing end of this sheet P reaches the switching gate 70, in the same way as above, transportation of the sheet P is stopped, and the switching gate 70 is driven. As a result, the trailing end of this sheet P enters the third sheet-transport path R3. Then, in the same way as above, reverse rotation of the forward-reverse rollers 90A is started, and this sheet P is sent to the output roller 442.

When sheets P are transported to the saddle-stitch unit 44, sheets P are sequentially transported so that a sheet stack P is formed. In this case, every time a new sheet P is transported, transportation of the sheet P along the first sheet-transport path R1, driving of the switching gate 70 (arranging the switching gate 70 so as to cross the first sheet-transport path R1), reverse rotation of the forward-reverse rollers 90A, and retraction of the switching gate 70 from the first sheet-transport path R1 are performed.

Figure 12:
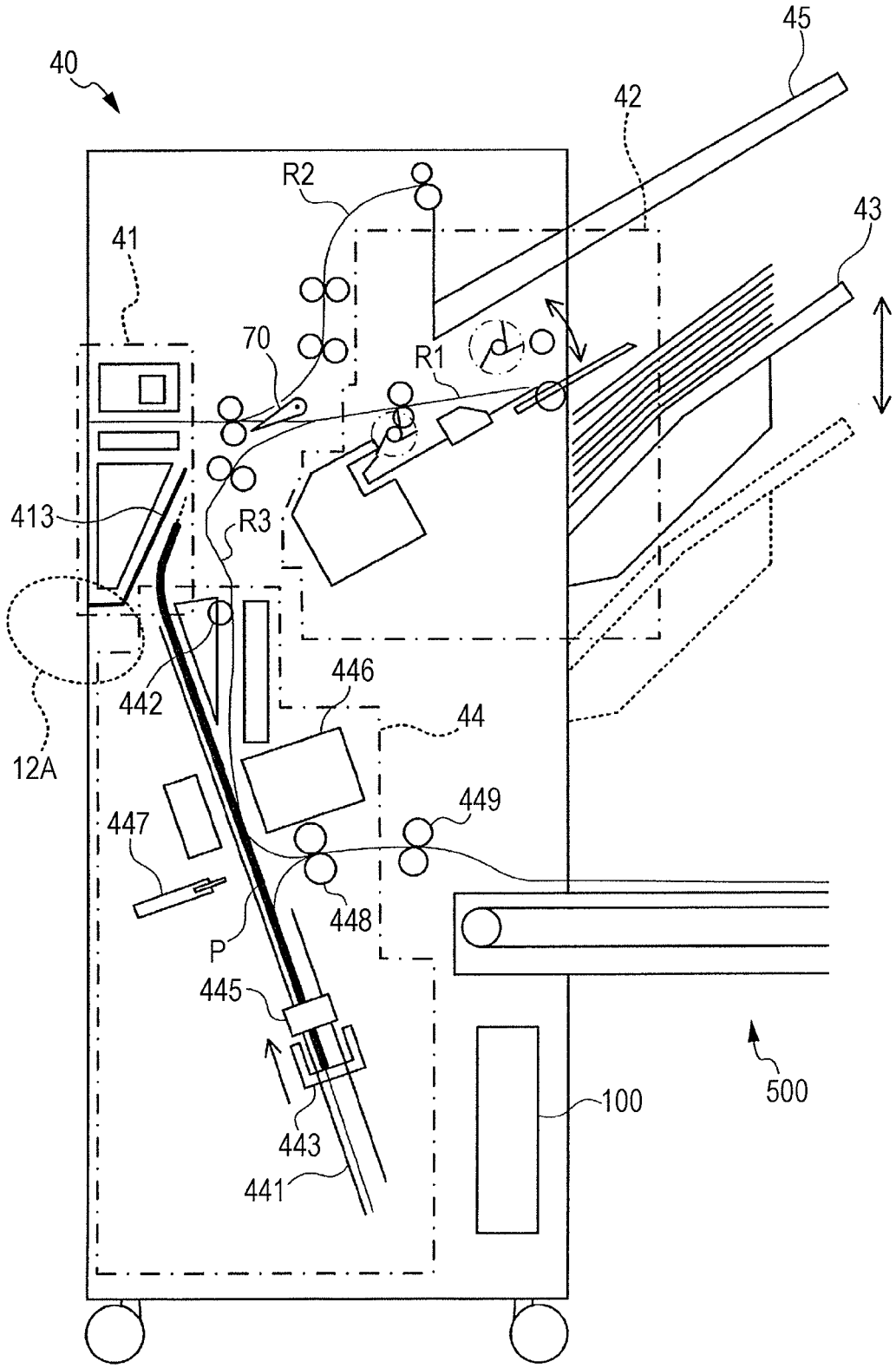
FIG. 12 illustrates an example of transporting a sheet stack.

As has been described above, in this exemplary embodiment, when a predetermined number of sheets P have been collected in the sheet collecting portion 441, the end guide 443, which serves as a part of a recording-material-stack transport unit, moves upward until the middle portion of the sheet stack P is located at the staple position of the stapler 446. At this time, the sheet stack P is moved upward by the end guide 443 along the sheet collecting portion 441. When the sheet stack P is long, as illustrated in FIG. 12, which illustrates an example of transporting the sheet stack P, the leading end of the sheet stack P advances toward the perforation unit 41. More specifically, in this exemplary embodiment, the perforation unit 41, which serves as a perforation-processing unit, is provided in the extension of the path along which the sheet stack P moves upward. When the sheet stack P is long, the leading end of the sheet stack P advances toward the perforation unit 41.

In this case, as described above, the leading end of the sheet stack P may come into contact with the perforation unit 41, and the movement of the sheet stack P may be restricted. However, in this exemplary embodiment, the partition wall 413 is provided in the perforation unit 41 so as to cross the transport path of the sheet stack P, more specifically, the partition wall 413 is arranged so as to intersect the transport path at an angle other than 90 degrees (i.e., so as to cross the transport path in an oblique direction). Thus, the sheet stack P is guided to the path beside the perforation unit 41, and the movement of the sheet stack P is not restricted by the perforation unit 41. The outer surface of the partition wall 413 may be regarded as a guide surface that guides the leading end of the sheet stack P to the path beside the perforation unit 41.

In this exemplary embodiment, the sheet stack P is guided to a space between the perforation unit 41 and the third sheet-transport path R3. More specifically, the sheet stack P is guided such that the leading end thereof is directed to the inside of the first post-processing unit 40. Although it may be possible to guide the sheet stack P in a direction opposite to the direction where the third sheet-transport path R3 is provided (a direction denoted by reference numeral 12A in FIG. 12, i.e., a direction toward the outside of the first post-processing unit 40) instead of to the third sheet-transport path R3, in such a case, the size of the first post-processing unit 40 has to be increased to prevent the sheet stack P from projecting from the unit. In contrast, as in this exemplary embodiment, by guiding the sheet P to the space between the perforation unit 41 and the third sheet-transport path R3, a wasted space is eliminated, and the size of the first post-processing unit 40 is less likely to increase.

The side-stitch stapler unit 42 collects a predetermined number of sheets P to form a sheet stack P and performs binding on this sheet stack P. This binding takes time. When one or more sheet stacks P (books) are to be produced, new sheets P (sheets P to be used to produce the next book) are transported to the side-stitch stapler unit 42 from the upstream side. That is, while the side-stitch stapler unit 42 is performing binding, new sheets P for producing a new sheet stack P (a new book) are transported thereto. The first post-processing unit 40 according to this exemplary embodiment temporarily retracts the trailing end of the newly transported sheet P from the first sheet-transport path R1.

Figure 13:
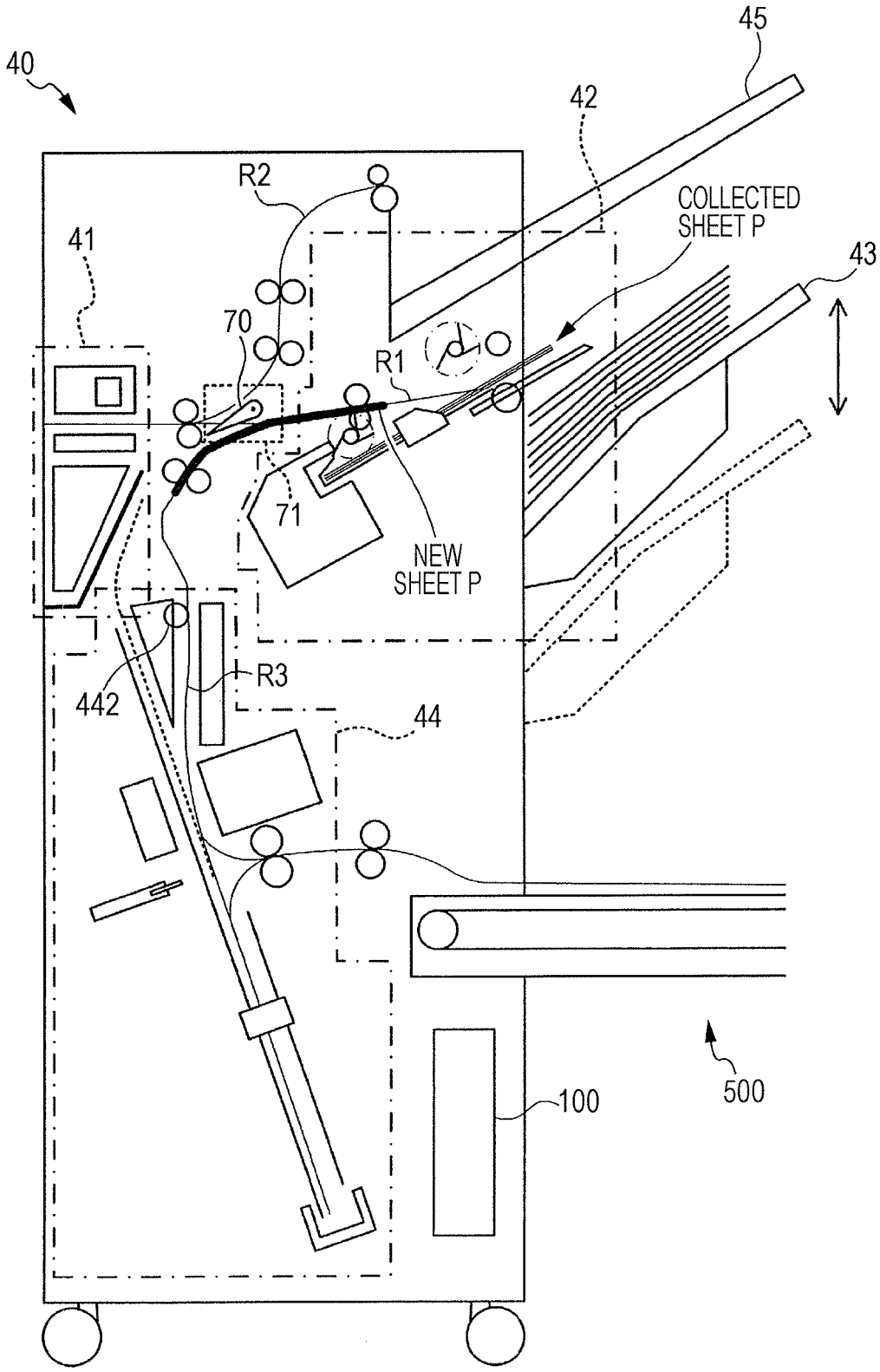
FIG. 13 is a diagram for explaining an operation performed when the trailing end of a sheet is retracted from a first sheet-transport path.
Figure 14:
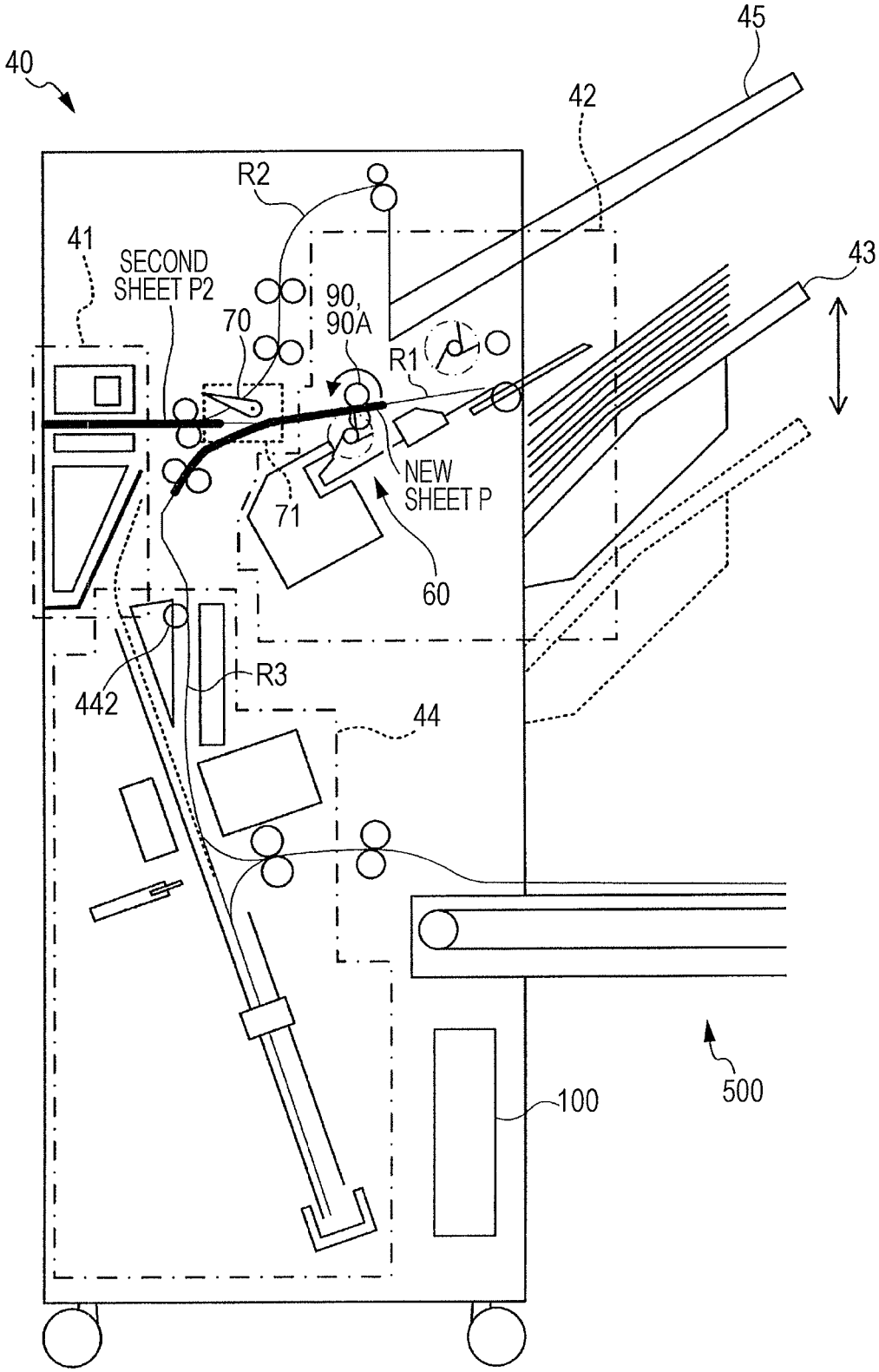
FIG. 14 is a diagram for explaining an operation performed when the trailing end of a sheet is retracted from the first sheet-transport path.

Referring to FIGS. 13 and 14, which illustrate an operation performed when the trailing end of the sheet P is retracted from the first sheet-transport path R1, a more detailed description will be given. When a new sheet P (a sheet P to be used to produce a next book: hereinbelow, a "new sheet P") is transported from the upstream side, first, the new sheet P is transported along the first sheet-transport path R1 until the trailing end thereof reaches the switching gate 70. At this time, the switching gate 70 is arranged to guide the new sheet P to the first sheet-transport path R1 (the switching gate 70 is retracted from the first sheet-transport path R1).

After the trailing end of the new sheet P reaches the switching gate 70, transportation of the new sheet P is temporarily stopped, and the switching gate 70 is driven. As a result, as described above, the trailing end of the new sheet P enters the third sheet-transport path R3. Then, reverse rotation of the forward-reverse rollers 90A is started. As a result, as illustrated in FIG. 13, the trailing end of the new sheet P is sent to the third sheet-transport path R3, and the trailing end of the new sheet P is retracted from the first sheet-transport path R1. Next, in this exemplary embodiment, as illustrated in FIG. 14, the switching gate 70 is retracted from the first sheet-transport path R1. Then, as illustrated in FIG. 14, a second sheet P (hereinbelow, a "second sheet P2") is transported from the upstream side. When the leading end of the second sheet P2 reaches a predetermined position (for example, after the leading end of the second sheet P2 passes through the switching gate 70), forward rotation of the forward-reverse rollers 90A is started. As a result, the new sheet P that has been temporarily sent to the third sheet-transport path R3 and the second sheet P2, laid on top of each other, are supplied to the sheet collecting portion 60. At this time, the preliminarily produced book (sheet stack P) is output, and no sheet P is on the sheet collecting portion 60.

When this processing is to be performed, transportation of the second sheet P2 does not need to be stopped. If transportation of the second sheet P2 is stopped, a sheet P following the second sheet P2 also needs to be stopped. Hence, the image forming operation in the image forming apparatus 2 (see FIG. 1) also needs to be stopped. In such a case, the number of sheets P printed per unit time decreases, lowering productivity. On the other hand, if the above-described processing is performed, transportation of the second sheet P2 does not need to be stopped, whereby lowering of productivity is suppressed.

If a new sheet P is simply made to stand-by on the first sheet-transport path R1, and forward rotation of the forward-reverse rollers 90A is started when the second sheet P2 is transported to a predetermined position, lowering of productivity may be suppressed. However, if a new sheet P is simply made to stand-by on the first sheet-transport path R1, the second sheet P2 transported thereto may slip under the new sheet P, and the new sheet P and the second sheet P2 may be stacked in a wrong order. When the trailing end of the new sheet P is retracted from the first sheet-transport path R1, as described above, the new sheet P and the second sheet P2 are stacked in a predetermined order.

Typically, the switching gate 70 is provided for each split portion where the sheet-transport path splits. In the configuration according to this exemplary embodiment, the first split portion B1 and the second split portion B2 are provided. Typically, the switching gate 70 is provided for each of the first split portion B1 and the second split portion B2.

On the other hand, in this exemplary embodiment, as described above, switching between the first sheet-transport path R1 and the second sheet-transport path R2 and switching between the first sheet-transport path R1 and the third sheet-transport path R3 are performed by a single switching gate 70. Accordingly, in this exemplary embodiment, compared with the case where the switching gate 70 is provided for each of the split portions, the number of parts is reduced, and the manufacturing cost is reduced. Furthermore, because the number of parts is reduced, the size of the apparatus is also reduced.

In this exemplary embodiment, as has been described above with reference to FIG. 10, the trailing end of the sheet P is pushed from the side by the switching gate 70 to guide the sheet P to the third sheet-transport path R3. However, the sheet P may be guided to the third sheet-transport path R3 by another method.

For example, the sheet P is transported along the first sheet-transport path R1 until the trailing end of the sheet P passes through the switching gate 70, and then, the switching gate 70 is driven. More specifically, after the trailing end of the sheet P has completely passed through the position where the switching gate 70 projects into the first sheet-transport path R1, the switching gate 70 is projected into the first sheet-transport path R1. Then, the forward-reverse rollers 90A are reversely rotated to transport the sheet P in the opposite direction. In this case, when the switching gate 70 is projected into the first sheet-transport path R1, the switching gate 70 does not touch the sheet P, so damage to the sheet P is reduced compared with the case where the sheet P is pressed from the side.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording-material processing apparatus comprising:

a binding mechanism that moves along a predetermined movement path and binds a recording material stack;

a recording-material transport path along which the recording material is transported, the recording-material transport path extending from a first area to a second area, the first area and the second area being next to each other with the movement path therebetween, and extending beside the movement path;

a first transport member that is provided in the first area, at a position away from the portion of the recording-material transport path extending beside the movement path, to transport the recording material on the recording-material transport path to the second area;

a second transport member that is provided in the second area, at a position away from the portion of the recording-material transport path extending beside the movement path, to transport the recording material transported by the first transport member to the further downstream side;

a switching member that switches transportation destination to which the recording material transported in the recording-material processing apparatus is transported, the switching member being provided downstream of the first transport member and upstream of the second transport member in a recording-material transport direction beside the recording-material transport path, on the opposite side of the portion extending beside the movement path from the movement path; and a guide member provided beside the recording-material transport path to guide the recording material transported along the recording-material transport path, the guide member comprising a hinge, which allows the guide member to move toward and away from the recording-material transport path.

2. The recording-material processing apparatus according to claim 1, further comprising:

a recording-material-stack forming unit that collects one or more recording materials transported downstream by the second transport member to form a recording material stack;

a recording-material-stack transport unit that transports the recording material stack formed by the recording-material-stack forming unit along a predetermined path;

a perforation-processing unit that is provided in an extension of the predetermined path and perforates the recording material; and a guide surface that guides a leading end of the recording material stack, which is transported by the recording-material-stack transport unit along the predetermined path, to the path extending beside the perforation-processing unit when the leading end reaches the perforation-processing unit.

3. The recording-material processing apparatus according to claim 2, wherein the guide surface guides the leading end to the inside of the recording-material processing apparatus.

4. An image forming system comprising:

an image forming apparatus that forms an image on a recording material;

a binding mechanism that moves along a predetermined movement path and binds recording materials having images formed thereon by the image forming apparatus;

a recording-material transport path along which the recording materials having images formed thereon by the image forming apparatus are transported, the recording-material transport path extending from a first area to a second area, the first and second areas being next to each other with the movement path therebetween, and extending beside the movement path;

a first transport member that is provided in the first area, at a position away from the portion of the recording-material transport path extending beside the movement path, to transport the recording material on the recording-material transport path to the second area; and a second transport member that is provided in the second area, at a position away from the portion of the recording-material transport path extending beside the movement path, to transport the recording material transported by the first transport member to the further downstream side;

a switching member that switches transportation destination to which the recording material transported in the recording-material processing apparatus is transported, the switching member being provided downstream of the first transport member and upstream of the second transport member in a recording-material transport direction beside the recording-material transport path, on the opposite side of the portion extending beside the movement path from the movement path; and a guide member provided beside the recording-material transport path to guide the recording material transported along the recording-material transport path, the guide member comprising a hinge, which allows the guide member to move toward and away from the recording-material transport path.

* * * * *